United States Patent [19]

Smith

[11] 4,199,325

[45] Apr. 22, 1980

[54] INHIBITING SPONTANEOUS COMBUSTION OF COAL

[75] Inventor: Robert H. Smith, Plano, Tex.

[73] Assignee: Atlantic Richfield Company, Los Angeles, Calif.

[21] Appl. No.: 963,053

[22] Filed: Nov. 22, 1978

[51] Int. Cl.[2] ..... C10L 5/00

[52] U.S. Cl. ..... 44/1 R; 44/1 G

[58] Field of Search ..... 44/1 R, 1 G, 10 D

[56] References Cited

U.S. PATENT DOCUMENTS

| | | | |
|---|---|---|---|
| 3,985,517 | 10/1976 | Johnson | 44/1 G |
| 4,043,763 | 8/1977 | Norman et al. | 44/1 G |

*Primary Examiner*—Carl F. Dees

*Attorney, Agent, or Firm*—Ronnie D. Wilson

[57] ABSTRACT

A method of inhibiting the spontaneous combustion of coal which comprises treating coal with carbon dioxide to deactivate the surface of the coal to oxygen.

4 Claims, No Drawings

INHIBITING SPONTANEOUS COMBUSTION OF COAL

Coal, whether it be of the lignite, sub-bituminous, bituminous or anthracite type, is susceptible to spontaneous combustion upon exposure to oxygen. The reactivity of coal to oxygen increases with decreasing rank making lignite the most reactive. The susceptibility of coal to spontaneous combustion is effected by various factors such as moisture content, particle size, temperature and oxidation rate, the most important of which is oxidation rate. Thus, lignite being the most reactive has the highest oxidation rate of all types of coal.

Spontaneous combustion occurs via the oxidation of coal from the air. Spontaneous combustion occurs when the rate of heat generation from oxidation exceeds the rate of heat dissipation. Previous workers have found that the reason spontaneous combustion does not occur more often than it does is that the oxidation rate of coal decreases with the increasing time of or extent of oxidation. Therefore, when coal is exposed to oxygen, a race begins between the effects of high temperature coefficient of oxidation rate and the decreasing rate of oxidation as oxygen is consumed by the coal. Depending on the winner, spontaneous combustion occurs or doesn't occur.

Generally, coal is dried to effect easier handling and reduce shipping costs; but by drying, the likelihood of spontaneous combustion is increased. Thus, steps should be and have been taken in the past to reduce the occurrence of spontaneous combustion.

Previously, attempts to reduce the possibility of spontaneous combustion have been be special storage treatments, treating the coal with petroleum products, calcium bicarbonate and/or amines. However, such previous treatments have not been completely effective or have been too expensive for use with coal.

Previous workers in the field found that by using oxygen, oxidized zones could be formed on the surface and the interior mass of brown coals which gave some protection against further oxidation. It was found that this treatment delayed the period of time that spontaneous combustion might occur, but does not greatly extend the period for safe storage of coal. Recently, U.S. Pat. No. 3,723,079 disclosed that the storage stability of dried lignite and sub-bituminous coal could be improved by treating the coal with oxygen at a temperature between 175° and about 225° C. and then rehydrating the oxygen treated coal with water. This technique improves the chances that spontaneous combustion will not occur, but does not provide the protection needed in these times of renewed interest in low cost coal mining activity with increased amount of coal being stored and transported long distances.

I have found a new, efficient and economical way of greatly inhibiting the possibility of spontaneous combustion of coal over previously set forth methods. My method for inhibiting spontaneous combustion of coal comprises treating coal with carbon dioxide. Treatment of coal with carbon dioxide can reduce the oxidation rate of coal to 15 percent of its initial rate for coal not treated with carbon dioxide.

The coal useful in the present invention includes all ranks of coal; but as previously stated, because of reactivity, lignite and sub-bituminous are effected the most by this treatment. Such coal can contain from about 20 to 40 percent water coming straight from the mine. For use in the method of the present invention, coal can be dried or undried; however, coal having a water level of about 1 percent to about 10 percent by weight is more suseptible to spontaneous combustion than wet coal and therefore the present invention is a very practical treatment for dried coal. The present invention can be applied to coal of any size but has a greater value with coal of smaller sizes due to the greater surface area subjected to oxidation.

To carry out the method of the present invention, pure carbon dioxide or a carbon dioxide containing gas such as flue gas may be employed at a temperature of from about 50° F. to about 300° F., preferably from about 100° F. to about 200° F. Since the adsorption of carbon dioxide on the coal is very rapid, about $1.2\times10^{-2}$ lb-mol/hr-lb at 75° F., about 500 times the rate of oxygen absorption under the same conditions, a very short residence time is required to deactivate the surface of the coal.

The carbon dioxide treatment may be carried out by conventional techniques utilizing a fluid bed treater or the gas could be introduced at the base of a coal pile.

After treatment, the coal can be handled, transported and/or stored without fear of spontaneous combustion.

In order to more fully illustrate the invention, the following example is given.

A sample of AMAX sub-bituminous coal of 0.051 inches particle size was dried to a 7.6 percent moisture content in a nitrogen atmosphere. At an oxidation temperature of 120° F. the oxidation rate was measured for a portion of the dried sample. The remaining portion of the sample was exposed to carbon dioxide for 10 hours at room temperature. The oxidation rates of both the treated and untreated sample were compared. The oxidation rate of the treated coal was found to be about 15 percent of the initial rate of the untreated coal.

Thus, from the foregoing, it is clear that the method of the present invention provides a way to inhibit spontaneous combustion of coal during storage, handling or transporting.

Therefore, I claim:

1. A method for inhibiting spontaneous combustion of coal which comprises adsorbing carbon dioxide at a temperature of from about 100° F. to about 200° F.

2. The method of claim 1 wherein said coal has a moisture content of no greater than 10.0 percent.

3. The method of claim 1 wherein said carbon dioxide is present in a flue gas.

4. The method of claim 1 wherein said coal is lignite or sub-bituminous.

* * * * *